US006092357A

United States Patent [19]

Wassenhoven et al.

[11] Patent Number: 6,092,357

[45] Date of Patent: Jul. 25, 2000

[54] SUPPORT DISK BEARING FOR AN OPEN-END SPINNING ROTOR

[75] Inventors: Heinz-Georg Wassenhoven; Claus-Dieter Landolt, both of Mönchengladbach; Bert Schlömer, Heinsberg; Andreas Riese; Arndt Hamann, both of Mönchengladbach, all of Germany

[73] Assignee: W. Schlafhorst AG & Co., Germany

[21] Appl. No.: 09/208,360

[22] Filed: Dec. 10, 1998

[30] Foreign Application Priority Data

Dec. 19, 1997 [DE] Germany ..... 197 56 711

[51] Int. Cl.[7] ..... D01H 4/12

[52] U.S. Cl. ..... 57/406; 384/549

[58] Field of Search ..... 384/549; 57/406, 57/404

[56] References Cited

U.S. PATENT DOCUMENTS

| | | | |
|---|---|---|---|
| 4,676,673 | 6/1987 | Strahlecker et al. | 384/549 |
| 4,892,422 | 1/1990 | Stahlecker | 57/406 |
| 4,893,946 | 1/1990 | Tesh et al. | 384/549 |
| 4,896,976 | 1/1990 | Stahlecker | 384/549 |
| 5,221,133 | 6/1993 | Braun et al. | 384/549 |
| 5,362,160 | 11/1994 | Braun et al. | 384/549 |
| 5,423,616 | 6/1995 | Gotz | 384/549 |
| 5,517,814 | 5/1996 | Stahlecker | 57/406 |

FOREIGN PATENT DOCUMENTS

| | | | |
|---|---|---|---|
| 34 47 600 C2 | 3/1987 | Germany . | |
| 36 15 777 A1 | 11/1987 | Germany . | |
| 37 19 445 A1 | 12/1988 | Germany . | |
| 38268851 | 2/1990 | Germany | 57/406 |
| 4121387 | 1/1993 | Germany | 384/549 |
| 195 11 000 C1 | 3/1995 | Germany . | |
| 195 49 466 A1 | 6/1997 | Germany . | |

*Primary Examiner*—William Stryjewski

*Attorney, Agent, or Firm*—Kennedy Covington Lobdell & Hickman

[57] ABSTRACT

A support disk bearing (1) for an open-end spinning rotor (9) with support disks (4, 5) arranged in pairs, each of which has a hub body (14) made of a metallic material and a bearing ring (15) made of a polymeric material. On its circumference, the hub body (14) has a radial circumferentially extending profiling (20), between whose V-shaped center structure (21) and lateral ribs (22, 23) the free flanks (24, 25) of an M-shaped bearing ring (15) can be fixed, and which has a thickness (D) which is almost constant in cross section.

9 Claims, 1 Drawing Sheet

SUPPORT DISK BEARING FOR AN OPEN-END SPINNING ROTOR

FIELD OF THE INVENTION

The present invention relates to a support disk bearing for an open-end spinning rotor with support disks arranged in pairs, each of which support disks has a hub body made of a metallic material and a peripheral outer bearing ring made of a polymeric material, and wherein the circumference of the hub body has a profile for mated affixation of the outer bearing ring.

BACKGROUND OF THE INVENTION

In support disk bearings of the type described above, there is the general problem that the peripheral bearing rings of the support disks are relatively strongly heated during operation, in particular because of the flexing work occurring between the rotor shaft and the bearing surface.

This problem occurs both with axial thrust-free support disk bearings and with support disk bearings having pairs of support disk arranged in a crossed manner in particular. With bearings having support disk bearings arranged in a crossed manner, flexing work is additionally generated by the rotor shaft because of an axial thrust component on the bearing ring. The frictional heat generated by this thrust component also stresses the bearing ring.

Thus, over time the material of the bearing ring becomes fatigued, with the result that damage occurs in the area of the peripheral bearing surface of the bearing ring. In addition, there is the danger that the bearing ring may become separated from the hub body, in particular in the edge area.

Many differing support disk bearings for open-end spinning rotors have been developed in the past, particularly differing in the shape of the bearing rings and in the manner in which the bearing rings are fixed in place on the hub body.

For example, German Patent Publication DE 34 47 600 A1 describes a support disk whose hub body has a groove on its exterior circumference into which the bearing ring, which is made of a plastic material, is cast and thereby axially fixed. In addition, the bearing ring has a so-called cooling groove on its outer circumference, i.e. in the area of its bearing surface, which is offset in respect to this groove.

A similar type of embodiment is known from German Patent Publication DE 36 15 777 A1. In this case the hub body has a radially projecting rib in its center area instead of a groove. The bearing ring of this known support disk is intentionally formed without a groove.

Other support disks which are part of the prior art have hub bodies with one or several grooves and/or one or several radially projecting ribs. Generally, the bearing ring of these support disks has a cooling groove (e.g., German Patent Publication DE 37 19 445 A1).

Although in connection with the above mentioned known support disks a partial dissipation of the heat generated by the flexing work could be achieved, the danger continues to remain that the bearing ring is separated from the hub body over time, in particular in the area of the outer edges of the bearing ring.

It has therefore already been proposed to clamp the flanks of the bearing ring in the hub body. For example, German Patent Publication DE 195 49 466 A1 describes a support disk with a hub body which has a bell-shaped profile on its exterior circumference as well as an annular groove, closed on itself, in the area of the lateral faces of the hub body. The bearing ring made of a polymeric material is cast into these structures, so that an almost interlocking fixation of the bearing ring on the hub body results.

Although an improvement of the fastening of the bearing ring on the hub body was achieved by this embodiment in accordance with German Patent Publication DE 195 49 466 A1, the known support disks are not yet optimal, in particular in respect to heat dissipation.

SUMMARY OF THE INVENTION

Based on the above mentioned prior art, it is an object of the invention to further improve the known support disks.

In accordance with the invention, this object is attained by a support disk bearing for an open-end spinning rotor basically comprising support disks arranged in pairs, each of which has a hub body made of a metallic material and a bearing ring made of a polymeric material, with the hub body having a radial profiling about the circumferential periphery thereof for affixation thereon of the bearing ring. According to the present invention, the profiling has an annular V-shaped center structure and lateral ribs spaced therefrom and the bearing ring is M-shaped in cross-section with free lateral flank portions for mated engagement with the profiling, the bearing ring having an essentially uniform thickness over its entire cross-section.

On the one hand, the support disk of the present invention has the advantage that, because of the coating thickness of the bearing ring, which is almost the same in all areas, there is assured a uniform dissipation into the hub body of the heat inevitably generated by flexing work during the rotation of the rotor shaft on the bearing surface of the support disk, so that it is possible to prevent heat accumulation areas in the bearing ring material, which prematurely age the material.

On the other hand, because of the interlocking clamping of the free flanks of the M-shaped bearing ring, it is assuredly prevented that the flanks become separated from the hub body over time.

The bearing ring preferably has a V-shaped cooling groove in the center area of the bearing surface. Such a cooling groove results in an enlargement of the convection surface, which also has a positive effect on the heat dissipation from the bearing ring.

In a preferred embodiment the V-shaped cooling groove is concavely arched on the groove bottom. It is possible by means of such concave arching to clearly reduce the danger of the formation of cracks in this area.

It is further preferred that the cooling groove has depth and a width of generally corresponding dimensions which results in an advantageous design of the bearing ring wherein, on the one hand, a sufficient dissipation of heat is assured and, on the other hand, the surface load, which acts on the bearing ring via the rotor shaft and is partially responsible for the generation of frictional heat, cannot become too great.

In a preferred embodiment, the free flanks of the M-shaped bearing ring extend convergingly. In this case, the free flanks are clamped between the V-shaped center area and the laterally arranged ribs of the radial profiling of the hub body. In this case, a circumferential undercut may advantageously be provided in the area of the base of the ribs to dependably prevent the free flanks from being loosened from the clamping, for example by the effects of the occurring centrifugal forces. Thus, the bearing ring is securely fixed in an interlocking manner on the hub body.

A further advantageous embodiment results from the hub body having convexly shaped lateral faces. Support disks of this type are distinguished by a low air resistance during operation which, in the case of open-end spinning machines having a multitude of such support disks in accordance with the invention, has a positive effect on the total energy consumption of the machine. Furthermore, the radiating surface of the hub body as a whole is increased because of these convexly shaped lateral surfaces and the heat dissipation to the environment is further improved thereby.

Further details, features and advantages of the invention can be understood from an exemplary embodiment described hereinafter by means of the drawings.

DETAILED DESCRIPTION OF THE PREFERRED EMBODIMENT

Figure 1:
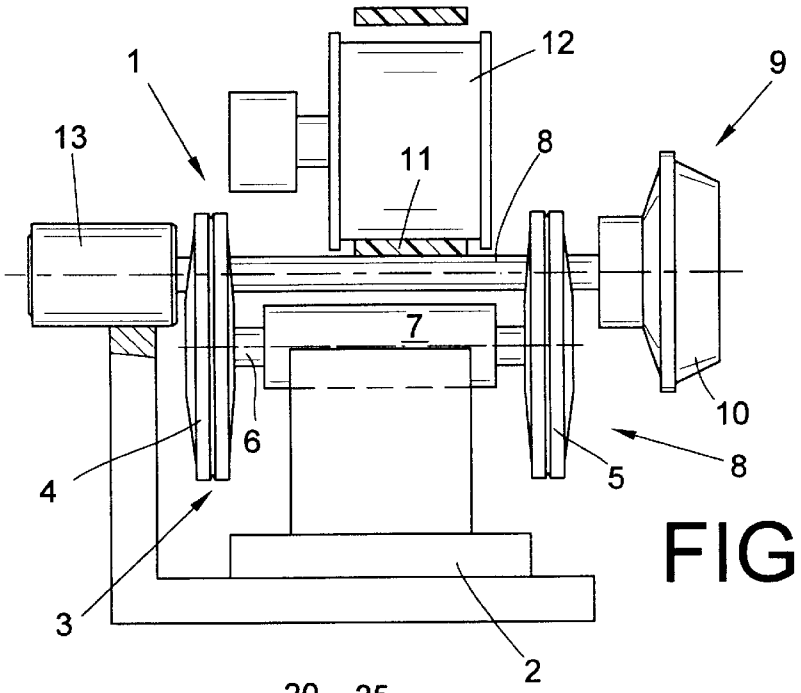
FIG. 1 is a side elevational view of a support disk bearing according to the present invention with a spinning rotor revolving in the bearing wedge of the support disk pairs.

Referring now to the accompanying drawings and initially to FIG. 1, a support disk bearing arrangement 1, such as is used in open-end rotor spinning devices, is shown in accordance with the present invention.

Customarily such support disk bearing arrangements 1 have two pairs of support disks, which are arranged on a bearing block 2 and form a bearing wedge between them. In this case the axes of the pairs of support disks can either be arranged in crossed relation, or they can extend parallel with each other.

With a crossed arrangement of the pairs of support disks, an axial thrust force acts on the rotor shaft during operation and maintains it in contact with a mechanical axial bearing (not shown) arranged on the end of the rotor shaft.

Only the support disk pair 3 of the two pairs of support disks, which is located at the front and includes the support disks 4 and 5, is shown in FIG. 1. In this case the support disks 4, 5 are fixed against relative rotation on a shaft 6 seated in a bearing housing 7. The bearing housing 7 in turn is fixed in place on the bearing block 2.

The spinning rotor 9 is seated with its rotor shaft 8 in the bearing wedge of the pairs of support disks, with its rotor cup 10 extended outwardly. Driving of the spinning rotor 10 takes place by means of a tangential belt 11 extending over the length of the machine and acting on the rotor shaft 8 when placed against it by a pressure roller 12.

Figure 2:
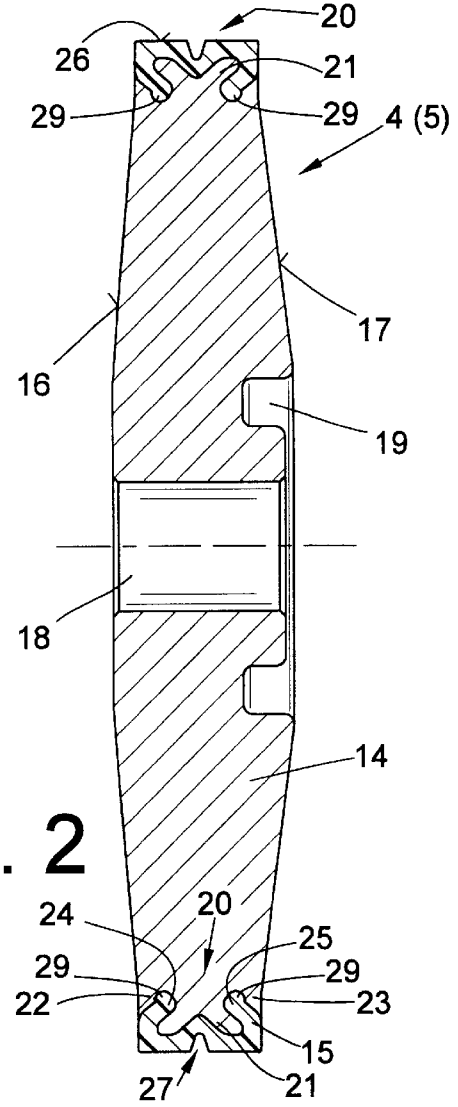
FIG. 2 is an enlarged cross-sectional view of one support disk in accordance with the present invention.

With the parallel arrangement of the axes of the pairs of support disks, such as indicated in FIG. 2, there is an axial thrust-free seating of the rotor shaft 8 in the bearing wedge of the support disk bearing. In this case, the spinning rotor 8 is axially positioned by means of a magnetic bearing 13 arranged at the end of the rotor shaft.

Each of the support disks 4, 5, represented in an enlarged scale in FIG. 2, has a metallic hub body 14 and a bearing ring 15, cast on the hub body 14 and preferably consisting of a polymeric material, for example polyurethane. The hub body 14 which, for example, is made of aluminum, has convexly shaped lateral faces 16, 17. In addition, the hub body 14 has a central through-bore 18, by means of which the support disks 4 and 5 can be fixed in place on the shaft 6 by means of a force fit. A receptacle 19 is also arranged in the central area of the lateral face 17, in which a brake element (not represented), which preferably is also convexly shaped, can be fixed in place.

Figure 3:
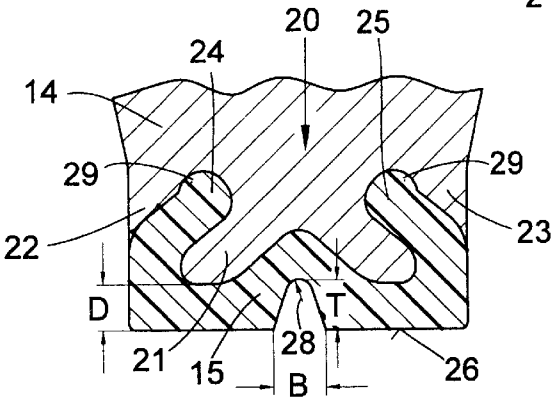
FIG. 3 is a further enlarged cross-sectional view of the periphery of the hub body of the support disk and the mated bearing ring.

The hub body 14 has an annular radially projecting profiling 20 on its outer circumferential periphery. As can also be seen in FIG. 3, this profiling 20 consists of a center annular structure 21, embodied in a generally V-shape, and two circumferential ribs 22, 23 arranged laterally of the center structure 21 at spacings from its opposite lateral sides.

A bearing ring 15 is cast around this profiling 20 and, as already indicated above, is made of a polymeric material and has an approximately M-shaped form. In this case the bearing ring 15 has a thickness D which is approximately constant over its entire cross-sectional surface. The free flanks 24, 25 of the bearing ring 15 are securely fixed in place between the V-shaped center structure 21 and the laterally arranged ribs 22, 23, each of which has an undercut 29 in the area of its base.

In addition, the bearing ring 15 has a V-shaped cooling groove 27 in the center of its bearing face 26, whose width B at least corresponds to the depth T. In addition, the cooling groove 27 has a concavely arched groove bottom 28.

It will therefore be readily understood by those persons skilled in the art that the present invention is susceptible of broad utility and application. Many embodiments and adaptations of the present invention other than those herein described, as well as many variations, modifications and equivalent arrangements, will be apparent from or reasonably suggested by the present invention and the foregoing description thereof, without departing from the substance or scope of the present invention. Accordingly, while the present invention has been described herein in detail in relation to its preferred embodiment, it is to be understood that this disclosure is only illustrative and exemplary of the present invention and is made merely for purposes of providing a full and enabling disclosure of the invention. The foregoing disclosure is not intended or to be construed to limit the present invention or otherwise to exclude any such other embodiments, adaptations, variations, modifications and equivalent arrangements, the present invention being limited only by the claims appended hereto and the equivalents thereof.

What is claimed is:

1. A support disk bearing for an open-end spinning rotor comprising support disks arranged in pairs, each of which has a hub body made of a metallic material and a bearing ring made of a polymeric material having an M-shaped cross-section, the hub body having a radial profiling about the circumferential periphery thereof for affixation thereon of the bearing ring, the profiling having a V-shaped center annular structure and ribs disposed laterally of the center annular structure at a spacing from opposite lateral sides thereof, each lateral rib defining a circumferential edge of the hub body, the bearing ring including free lateral flank portions extending between the ribs and the center annular structure for mated engagement with the profiling.

2. The support disk bearing in accordance with claim 1, wherein the bearing ring has a circumferential cooling groove of an approximately V-shape.

3. The support disk bearing in accordance with claim 2, wherein the cooling groove has a concavely curved groove bottom.

4. The support disk bearing in accordance with claim 2, wherein the cooling groove has depth and a width of generally corresponding dimensions.

5. The support disk bearing in accordance with claim 1, wherein the free flanks of the M-shaped bearing ring extend convergingly toward one another.

6. The support disk bearing in accordance with claim 1, wherein each of the lateral ribs of the hub body has a circumferential undercut in a base area thereof.

7. The support disk bearing in accordance with claim 1, wherein the hub body has convexly shaped lateral faces.

8. The support disk bearing in accordance with claim 1, wherein the bearing ring includes a substantially uniform material thickness along the M-shaped cross-section.

9. A support disk bearing for an open-end spinning rotor comprising support disks arranged in pairs, each disk of the pair having (i) a hub body made of a metallic material and having a radial profiling about the circumferential periphery thereof, the profiling having a V-shaped center annular structure and lateral ribs spaced therefrom, and (ii) a bearing ring affixed on circumferential periphery of the hub body, the bearing ring being made of a polymeric material having (a) an M-shaped cross-section with a substantially uniform material thickness therealong, (b) free lateral flank portions for mated engagement with the profiling, and (b) an approximate V-shaped circumferential cooling groove having a depth and a width of generally corresponding dimensions.

* * * * *